US005159794A

United States Patent [19]

Habbersett et al.

[11] Patent Number: 5,159,794

[45] Date of Patent: Nov. 3, 1992

[54] JAMB LINER SLOT COVER

[75] Inventors: John I. Habbersett; Norman R. Westfall, both of Rochester, N.Y.

[73] Assignee: Caldwell Manufacturing Company, Rochester, N.Y.

[21] Appl. No.: 680,569

[22] Filed: Apr. 4, 1991

[51] Int. Cl.[5] ..... E06B 1/04

[52] U.S. Cl. ..... 52/207; 49/453; 52/204; 52/716

[58] Field of Search ..... 52/202, 204, 207, 208, 52/716; 49/453

[56] References Cited

U.S. PATENT DOCUMENTS

| | | | |
|---|---|---|---|
| 1,940,279 | 12/1933 | Washburn . | |
| 1,998,791 | 4/1935 | Schanz . | |
| 2,767,444 | 10/1956 | Spraragen . | |
| 3,145,433 | 8/1964 | Jones . | |
| 3,482,354 | 12/1969 | Trout | 49/453 |
| 4,227,345 | 10/1980 | Durham, Jr. | 49/453 |
| 4,271,631 | 6/1981 | Trout . | |
| 4,724,577 | 2/1988 | Langley . | |
| 4,822,060 | 4/1989 | Moyer et al. . | |
| 4,837,976 | 6/1989 | Westfall et al. . | |
| 4,941,285 | 7/1990 | Westfall . | |

*Primary Examiner*—Michael Safavi

*Attorney, Agent, or Firm*—Eugene Stephens & Associates

[57] ABSTRACT

An integral strip of resin material is used to cover exposed portions of jamb liner slots of take-out windows. Side walls on either side of the slot are displaced by passage of the tubular body. The winged flanges are drawn partly into the slot against outer portions of the side walls by a snap-fit engagement between inner portions of the side walls and the tubular part. Resilience of the winged flanges against the outer portions of the side walls helps to hold the strip in place and cover the slots. The tubular part of the strip also serves as a stop for limiting movement of a windown sash along the liner.

19 Claims, 3 Drawing Sheets

JAMB LINER SLOT COVER

BACKGROUND

Jamb liners, particularly those used for mounting take-out windows, include slots for exposing shoes at ends of window sash counterbalances. The shoes track within channels formed in the liners and are connected to the window sash by pins that project through the slots.

As a matter of manufacturing convenience, the slots are formed along the full height of the jamb liners, even though the shoes are required to track along only part of the jamb height. The unused part of the slots, particularly apparent in lower sash runs of double-hung windows, present an unsightly view when the lower sash is closed. The slot opening in the jamb liner also permits contaminants to enter the shoe channel and adjacent spring channels, which possibly harm or obstruct operation of the window balance system.

There are slot covers that have been used in the past to close these slots, but it has been necessary to insert these covers into place before the jamb liners are installed. The known cover has a generally H-shaped configuration formed by two interconnected flanges that engage portions of the jamb liner adjacent to the slot, and this prevents the slot cover from being easily removed or replaced once the window has been assembled.

SUMMARY OF THE INVENTION

We have invented a new slot cover for closing the slot of a shoe channel in a jamb liner. The cover does not have to be slid endwise onto the jamb liner. Instead, our slot cover snaps into the slot, and this allows it to be fit into the slot, removed from the slot, or even replaced after the jamb liners have been installed.

The slot cover is integrally molded in the form of a strip having a generally tube-shaped body and a pair of wing-shaped flanges that project from a shoulder on the tube-shaped body. The tube-shaped body is dimensioned so that it snaps into the slot between side walls of the slot and draws the wing-shaped flanges against respective outer portions of the same slot side walls. Although molded together, the tube-shaped body is made with much thicker walls than the wing-shaped flanges. The added thickness of the tube-shaped body makes the body more rigid so that it can spring apart the side walls of the slot without significantly deforming. However, the reduced thickness of the wing-shaped flanges makes the flanges more flexible so that the flanges can be drawn into engagement with the outer portions of the side walls by a spring force exerted between inner portions of the side walls and the tube-shaped body. This makes a snug fit and keeps the slot cover from shifting along the slot. It also provides a seal to prevent air from circulating through the slot into the shoe channel.

Although the tube-shaped body of our slot cover preferably includes a cylindrical cross-sectional shape, the tube-shaped portion can also be fashioned in cross section from a truncated cylindrical shape that remains sufficiently rigid to resist deformation. However, it is important that enough of the cylinder shape remains to act as a guide for separating the side walls of the jamb liner slot.

Variations in both the shoulder and the wing-shaped flanges of our slot cover can also be made to accommodate differently configured slots. For example, the shoulder can be varied in length to accommodate different amounts of separation between inner and outer portions of the slot side walls, which respectively engage the tube-shaped body and the wing-shaped flanges. The wing-shaped flanges can also be varied in curvature from positions within a plane of tangency to the tube-shaped body to positions parallel to the tube-shaped body to accommodate different angular orientations of the outer side wall portions against which the flanges are drawn.

The slot cover can also be dimensioned in length to serve as a stop for limiting travel of a window sash. More particularly, the rigid tube-shaped body fits into the slot and interferes with the travel of shoes connected to the sash. This, for example, prevents a lock on the upper rail of a lower sash from being driven into the top of the window frame.

DRAWINGS

DETAILED DESCRIPTION

Figure 1:
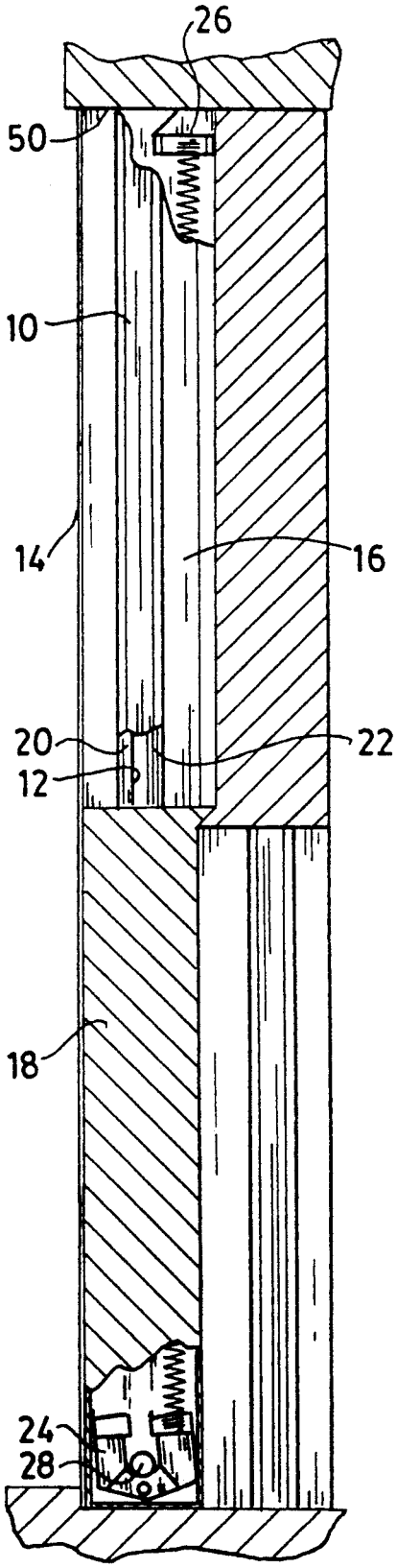
FIG. 1 is a fragmentary view taken partly in cross section through a window frame showing a first embodiment of our slot cover positioned within a slot of the jamb liner.
Figure 2A:
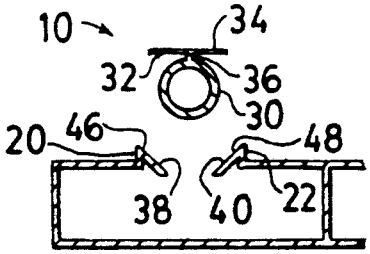
FIG. 2 shows a series of three end views, labeled a, b, and c, of the first slot cover in a sequence of positions for mounting the slot cover, namely, before, during, and after entry of the slot cover into the jamb liner slot.
Figure 2B:
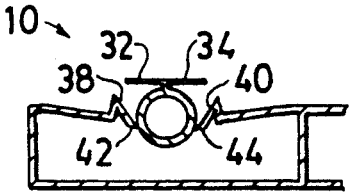
Figure 2C:
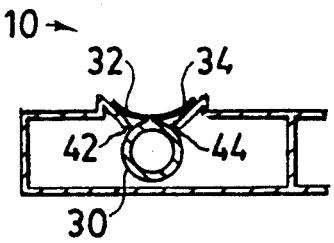
Figure 3:
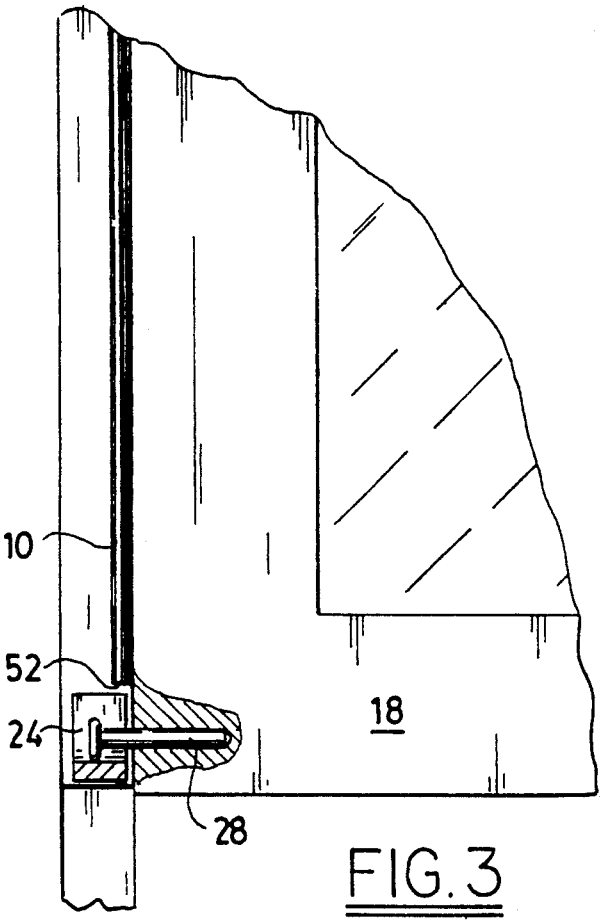
FIG. 3 is a side view partly in cross section exposing the slot cover along a section of the jamb liner in contact with a sash shoe limiting further upward movement of a window sash.

Our jamb liner slot cover 10, as shown in FIGS. 1–3, is adapted to fit within a slot 12 of a conventional tilt window jamb liner 14. The slot 12 is formed in the sash run 16 of a tilt window sash 18. Tracks 20 and 22 are formed on either side of the slot for guiding the plow of sash 18 along the sash run 16.

The slot 12 forms an opening for connecting a shoe 24 of a counterbalance spring system 26 to a pin 28 carried at the lower end of window sash 18. An example of the type of jamb liner and balancing system appropriate for use with our slot cover is disclosed in commonly assigned U.S. Pat. No. 4,941,285. The entire disclosure of this patent is hereby incorporated by reference to provide additional details of the type of jamb liner and window balancing system that would derive particular benefit from our invention.

FIG. 2 shows a series of end views of the slot cover 10 in a progression of positions with respect to the jamb liner 14. The depicted slot cover 10 is preferably extruded as an integral resin strip having a tube-shaped body 30 and a pair of wing-shaped flanges 32 and 34 that are joined to the tubular body at shoulder 36. From the views "a" and "b" of FIG. 2, where the winged flanges 32 and 34 are positioned out of contact with the liner, the winged flanges can be seen to extend substantially in alignment with each other and tangent to the tubular body 30 at shoulder 36.

However, in the view "b" of FIG. 2, the tubular body 30 has begun to partially separate sloping side walls 38 and 40 on opposite sides of the slot 12. The separation occurs because the diameter of the tubular body 30 is larger than the width of the slot 12 separating the two side walls. Although the sloping side walls 38 and 40 exhibit considerable resilience as respective molded parts of the tracks 20 and 22, the tubular body 30 is made of sufficient thickness to spring apart the sloping side walls 38 and 40 without significantly deforming, and this allows passage of the tubular body into the slot 12.

In the view labeled "c" in FIG. 2, respective inner end portions 42 and 44 of the sloping side walls 38 and 40 are snap fit against the tubular body and urge the tubular body 30 further into the slot. However, the further movement of the tubular body into the slot is limited by contact between the winged flanges 32 and 34 and respective outer portions 46 and 48 of the sloping side walls. Nevertheless, the more flexible flanges are drawn partly into the slot against the outer portions 46 and 48 of the sloping side walls by the resilient engagements of the inner ends 42 and 44 of the sloping side walls with the tubular body 30.

The winged flanges 32 and 34 are drawn into the slot 12 until the resilient force exerted by the sprung-apart sloping side walls 38 and 40 on the tubular body 30 is offset by another resilient force exerted by the further flexing of the winged flanges away from the tubular body. Together, the opposing resilient forces hold the slot cover 10 tightly in place against the outer portions 46 and 48 of the sloping side walls and prevent the slot cover from shifting along the slot.

Figure 5:
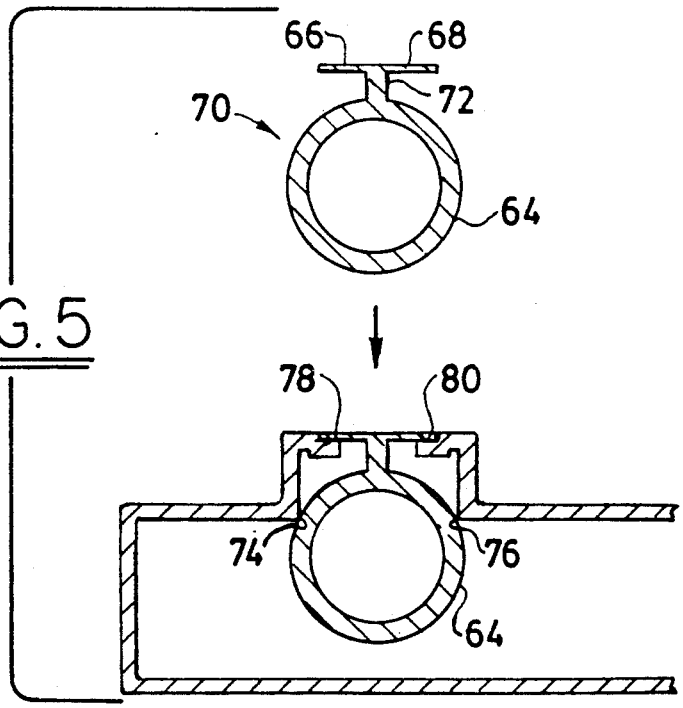
FIG. 5 is an enlarged end view of a third slot cover embodiment shown both before and after engagement with a different jamb liner slot configuration.

A cross-sectional view exposing a side of the slot cover 10 as it would appear fastened in place within the slot 12 is shown in FIG. 5. However, in the view of FIG. 5, the window sash 18 has been moved upward along the sash run 16 until the sash shoe 24 has come into contact with an end 52 of the tubular body 30. The end 52 functions as a stop for preventing the sash from banging into the top of window frame 50. Actually, the stop first prevents further vertical rise of the shoe 24, but not the sash itself. For example, the design of shoe 24 enables the pin 28, together with the sash 18, to rise a further distance independently of the shoe to disconnect the sash from the shoe. However, the end 52 of the slot cover can still be positioned to interrupt the further rise of the sash pin 28 to protect the top of the window frame 50. Also, although only one jamb liner and one slot cover are illustrated, it may be understood that the sash 18 is guided on opposite sides by similar jamb liners; and the slot covers for each of these jamb liners are preferably made equal in length to provide a common stop for preventing further upward movement of the shoes within each liner.

Figure 4:
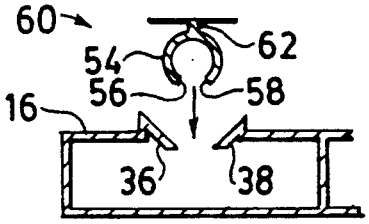
FIG. 4 is an end view of a second embodiment of our slot cover shown both before and after engagement with the same jamb liner slot configuration.

A second embodiment of our jamb liner slot cover is shown in FIG. 4. Instead of a tube-shaped body being defined by a complete hollow cylinder, the tubular body 54 of slot cover 60 is shaped as a truncated hollow cylinder. However, the tubular body 54 continues to be shaped in cross section by a major portion of a hollow cylinder. In fact, truncated ends 56 and 58 of the cylinder extend substantially equal distances from shoulder 62 to positions that are spaced apart through a chordal distance that is less than the diameter of the cylinder. The limited spacing between the ends 56 and 58 assures that enough of the cylinder remains to act as a guide for separating the side walls 38 and 40 of the jamb liner slot. It is also important that the walls of the remaining body portion be made of increased thickness to assure sufficient rigidity for separating the slot side walls.

Figure 6:
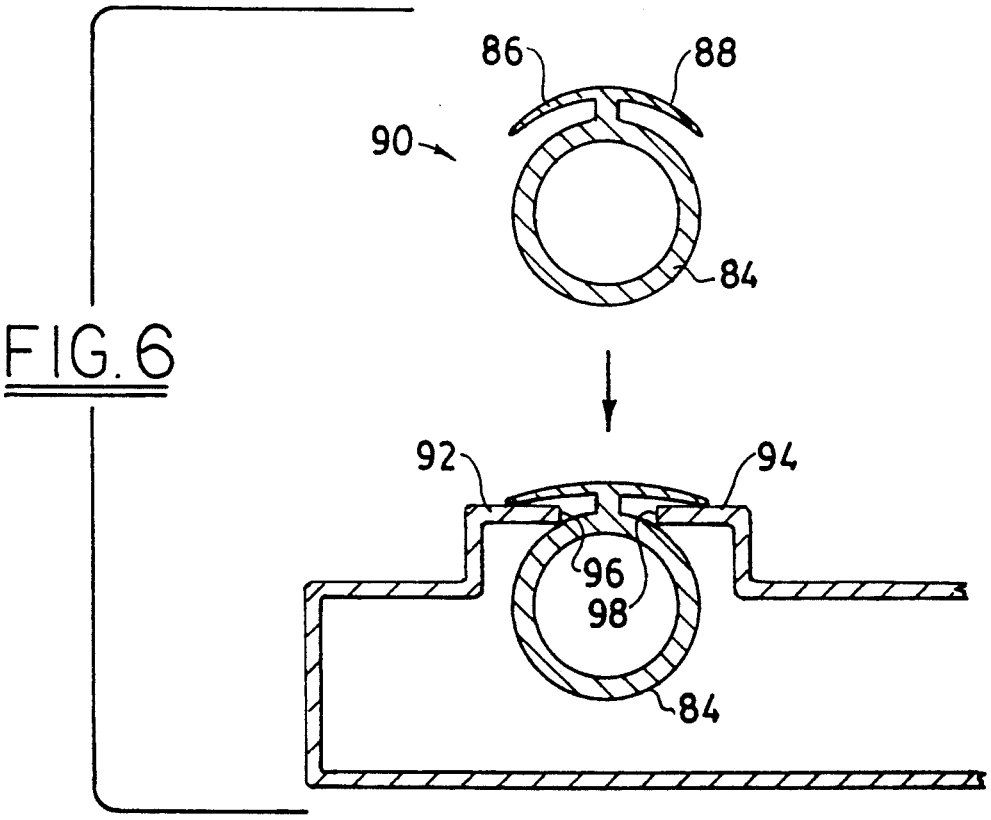
FIG. 6 is an enlarged end view of a fourth slot cover embodiment that is also shown both before and after engagement with another different jamb liner slot configuration.

The remaining drawing FIGS. 5 and 6 depict alternative embodiments of our slot cover for accommodating differently configured jamb liner slots. For example, FIG. 5 depicts a slot cover 70 that has an extended shoulder portion 72 connecting wing-shaped flanges 66 and 68 to tube-shaped body 64. The lengthening of shoulder 72 is intended to accommodate a separation between inner corner portions 74 and 76 and outer portions 78 and 80 of the slot side walls. This enables the inner corner portions 74 and 76 of the slot walls to engage the tubular body 64 and to exert an appropriate amount of force for drawing the winged flanges 66 and 68 into a snug fit engagement with the respective slot wall outer portions 78 and 80.

In FIG. 6, a slot cover 90 includes curved wing-shaped flanges 86 and 88 that are designed to accommodate slot side walls 92 and 94 that are aligned with each other in a common plane. The winged flanges 86 and 88 are curved toward tube-shaped body 84 into positions that are substantially parallel to the tubular body. This enables inner end portions 96 and 98 of the slot side walls to exert a resilient force against the tubular body 84 matching a resilient force exerted by the winged flanges 86 and 88 on the side walls opposing their separation from the tubular body.

The four above-described slot covers 10, 60, 70, and 90 are preferably made of a resin material such as polypropylene. Although it will be apparent to those of skill in the art that a wide variety of other materials could be used for the practice of our invention, polypropylene is preferred because the material exhibits the requisite qualities of rigidity and flexibility with variations in thickness and exhibits relatively low friction against conventional jamb liner materials.

We claim:

1. A jamb liner slot cover for covering an exposed portion of a slot that is formed between side walls in a sash run comprising:

an integral strip of resinous material having a tube-shaped body and wing-shaped flanges that project from opposite sides of a shoulder on said tubular body; said tubular body being made of sufficient thickness to spring apart the side walls of the sash run and allow passage of said tubular body through the sash run; and said winged flanges being made of a reduced thickness to allow said winged flanges to be drawn into snug engagement with the side walls by a spring force exerted between the side walls and said tubular body.

2. The slot cover of claim 1 in which said tubular body has a diameter that is larger than a width of the slot measured between inner portions of the side walls.

3. The slot cover of claim 2 in which said winged flanges are made sufficiently thin to be flexed against outer portions of the side walls by contact between the inner portions of the side walls and said tubular body.

4. The slot cover of claim 3 in which said tubular body together with said winged flanges is drawn down into the slot until a resilience exerted by the sprung-apart side walls on said tubular body is offset by an opposing resilience exerted by flexing said winged flanges away from said tubular body.

5. The slot cover of claim 4 in which the resilience exerted by the side walls and the winged flanges also provides for holding the slot cover in place to prevent its movement along the slot.

6. The slot cover of claim 5 in which said tubular body is shaped in cross section as a hollow cylinder that extends along the length of said integral resin strip.

7. The slot cover of claim 5 in which said tubular body is truncated, leaving said tubular body shaped in cross section by a major portion of a hollow cylinder extending along the length of said integral resin strip.

8. The slot cover of claim 7 in which truncated ends of the cylinder extend substantially equal distances from said shoulder and are spaced apart through a chordal distance that is less than the diameter of the cylinder.

9. The slot cover of claim 5 in which said shoulder is extended to accommodate separation between the inner and outer portions of the side walls within the slot.

10. The slot cover of claim 5 in which said winged flanges are curved toward said tube-shaped body.

11. In a tilt window having a sash guided between a pair of vertical jamb liners including spring systems housed within each of the jamb liners; sash shoes biased by the spring systems for upward movement within respective slots formed along sash runs of the liners; pins connecting each of the shoes to the sash for counterbalancing weight of the sash with the spring systems; tracks formed on either side of the slots for guiding plow portions of the sash along the sash runs; and each track supported in part by a side wall on either side of the slots; the improvement wherein:

jamb liner slot covers are snap fit into exposed portions of the slots against outer portions of the side walls, forming respective stops for limiting upward movement of the shoes; and each of said slot covers includes a tubular body and winged flanges that extend from a shoulder on said tubular body.

12. The improvement of claim 11 in which said tubular bodies are made more rigid than said winged flanges.

13. The improvement of claim 12 in which the side walls are displaced by passage of said tubular bodies into respective slots and said winged flanges are flexed by resilient forces exerted by inner portions of the side walls against said tubular bodies, drawing the winged flanges against outer portions of the side walls.

14. The improvement of claim 11 in which said slot covers that are snap fit into the respective slots are substantially equal in length.

15. The improvement of claim 14 in which each of said stops are formed by respective ends of said tubular bodies that extend into the slots and interfere with the upward movement of the shoes.

16. A system for sealing an exposed portion of a slot formed between side walls of window sash tracks in a jamb liner comprising:

integral resin strip sized in length to cover the exposed portion of the slot;

a tubular part of the strip sized in diameter larger than a space that separates inner portions of the side walls on opposite sides of the slot; and a winged part of the strip extending substantially tangent to said tubular part and having flexible flanges that are drawn partly into the slot against outer portions of the side walls by a snap-fit engagement between said tubular part and the inner portions of the side walls.

17. The system of claim 16 in which said winged part is made thinner than said tubular part to increase flexibility of said winged part while maintaining said tubular part of sufficient thickness to separate the side walls without significantly deforming.

18. The system of claim 17 in which resilience exerted by flexing the winged part provides for holding the strip in place to prevent its movement along the slot.

19. The system of claim 18 in which said integral resin strip is extruded from polypropylene.

* * * * *